United States Patent [19]

Horino et al.

[11] Patent Number: 5,022,531

[45] Date of Patent: Jun. 11, 1991

[54] PACK-COMPRISING BUNDLE PROCESSING APPARATUS WITH PACK COUNTING MEANS

[75] Inventors: Shigeo Horino; Hideo Omura; Nobusato Maruyama, all of Tokyo; Yoshiaki Ashikawa, Kanagawa; Masatoshi Shioya, Kanagawa; Toshiyuki Miyano, Kanagawa; Jiro Wakou, Kanagawa, all of Japan

[73] Assignee: Kabushiki Kaisha Toshiba, Kanagawa, Japan

[21] Appl. No.: 318,228

[22] Filed: Mar. 2, 1989

[30] Foreign Application Priority Data

Mar. 29, 1988 [JP] Japan ..... 63-75171

[51] Int. Cl.[5] ..... B07C 5/00

[52] U.S. Cl. ..... 209/552; 209/534; 209/579; 209/936; 53/53

[58] Field of Search ..... 209/534, 551, 546, 579, 209/552, 936; 53/53

[56] References Cited

U.S. PATENT DOCUMENTS

| | | | |
|---|---|---|---|
| 3,930,582 | 1/1976 | Gartner et al. | 209/534 |
| 3,932,272 | 1/1976 | Carnes, Jr. et al. | 209/534 |
| 4,025,420 | 5/1977 | Horino | 209/534 |
| 4,414,730 | 11/1983 | Omura et al. | 209/534 X |
| 4,458,816 | 7/1984 | Horino et al. | 209/534 X |
| 4,483,124 | 11/1984 | Ohba et al. | 209/534 X |
| 4,653,647 | 3/1987 | Hashimoto | 209/551 X |
| 4,722,443 | 2/1988 | Maruyama et al. | 209/534 |
| 4,830,742 | 5/1989 | Takesako | 209/551 X |
| 4,845,917 | 7/1989 | Omura et al. | 209/534 X |

*Primary Examiner*—Margaret A. Focarino
*Assistant Examiner*—Andrew C. Pike
*Attorney, Agent, or Firm*—Finnegan, Henderson, Farabow, Garrett, and Dunner

[57] ABSTRACT

A bundle processing apparatus includes a receiving conveyor for receiving a plurality of bundles, each bundle including a number of packs and each pack including a plurality of paper sheets, a removing conveyor for removing bundles from the receiving conveyor, a counter for counting the number of packs included in each bundle removed by the removing conveyor, a length detector for detecting the length of each bundle, a stacking device for stacking a bundle when the number of packs counted by the counter is equal to a predetermined number and the length detected by the length detector is equal to a predetermined length, a device for rejecting a bundle when the number of packs counted by the counter is not equal to the predetermined number or the length detected by the detector is not equal to the predetermined length, and a storage device having a storage box for storing the stacked bundles.

7 Claims, 13 Drawing Sheets

DATE : 8-16 TIME : 15 : 30 MACHIN No : 12 JOURNAL No : 123

| | | | | | |
|---|---|---|---|---|---|
| DENOMI | NUMBER | $ 1 | 25 | AMOUNT | $ 25000 |
| DENOMI | NUMBER | $ 10 | 25 | AMOUNT | $ 250000 |
| DENOMI | NUMBER | $ 100 | 25 | AMOUNT | $ 2500000 |
| | | | KEY-IN | AMOUNT | $ 2775000 |
| | | | TOTAL | AMOUNT | $ 2775000 |

PACK-COMPRISING BUNDLE PROCESSING APPARATUS WITH PACK COUNTING MEANS

BACKGROUND OF THE INVENTION

1. Field of the Invention

The present invention relates to a bundle processing apparatus for receiving and inspecting a bundle, such as a bundle having a predetermined number of bank notes.

2. Description of the Prior Art

In department stores and banks, at the close of the workday, operators determine the sales amount at each department or deposit counter. A large number of bank notes are counted by a bank note counting machine to identify the sales amount in bank notes. The bank notes are bundled by a bundling device with 100 bank notes in a pack and ten packs of bank notes in a bundle. The bank notes are then transported to the head offices of the department stores or main banks. The head offices accept the bank notes at a deposit counter and count the number of bank notes.

At the deposit counter an operator checks the denomination of each bank note in addition to the amount, stamps the bundle and registers the data. Then, the bundles are stored in a box and the box is placed in a safe.

As described above, in the prior art system, manual labor is required to convey the bundle, check the denomination and amount of notes, and store the bundles in a box.

Another known system is disclosed in U.S. Pat. No. 4,845,917 owned by the same assignee as the present invention. In this system, a predetermined number of bundles of bank notes are placed on an input portion. The bundles are taken out one by one from the input portion by a take-out device and are transferred to the inspecting apparatus by a conveyor mechanism. In the inspecting apparatus, the bank notes are picked up one by one from the bundles, for inspection.

SUMMARY OF THE INVENTION

It is an object of the present invention to provide a bundle processing apparatus and method of inspecting bundles of paper sheets with higher efficiency than that of the prior art systems.

Another object of the present invention is to automatically check the number of packs of paper sheets such as bank notes, in a bundle.

The foregoing objects of the present invention are achieved by providing a bundle processing apparatus with a pack counting device including a portion for receiving a plurality of bundles, each bundle including a number of packs and each pack including a plurality of paper sheets. The invention also includes a portion for removing the bundles from the receiving portion and for counting the number of packs included in each bundle. The invention includes a detecting portion for detecting the length of each bundle, a stacking device for stacking a bundle when the number of packs counted by the counting portion is equal to a predetermined number and the length detected by the detecting portion is equal to a predetermined length. The invention includes a rejecting portion for rejecting bundles when the number of packs counted by the counting portion is not equal to the predetermined number and the length detected by the detecting means is not equal to a predetermined length. The invention is also provided with a storing portion for storing the stacked bundles in a storage box.

BRIEF DESCRIPTION OF THE DRAWINGS

The manner by which the above and other objects are obtained will be fully apparent from the following detailed description when considered with the accompanying drawings, wherein.

DETAILED DESCRIPTION OF PREFERRED EMBODIMENTS

The bundle processing apparatus according to the invention includes an input portion on which a predetermined number of bundles are placed, each bundle including a predetermined number of packs, and each pack including a predetermined number of paper sheets. A take-out means takes out the bundles placed on the input portion one by one. A receiving means receives the bundles from the take-out means. A detecting means detects the number of packs included in the bundle received by the receiving means. A rejecting means rejects the bundles which are not determined to include the predetermined number of packs based on the results of the detecting means. A stacking portion stacks the bundles which are determined to include the predetermined number of packs based on the results of the detecting means, and a storing means stores the bundles stacked on the stacking portion into a storing box.

Figure 1:
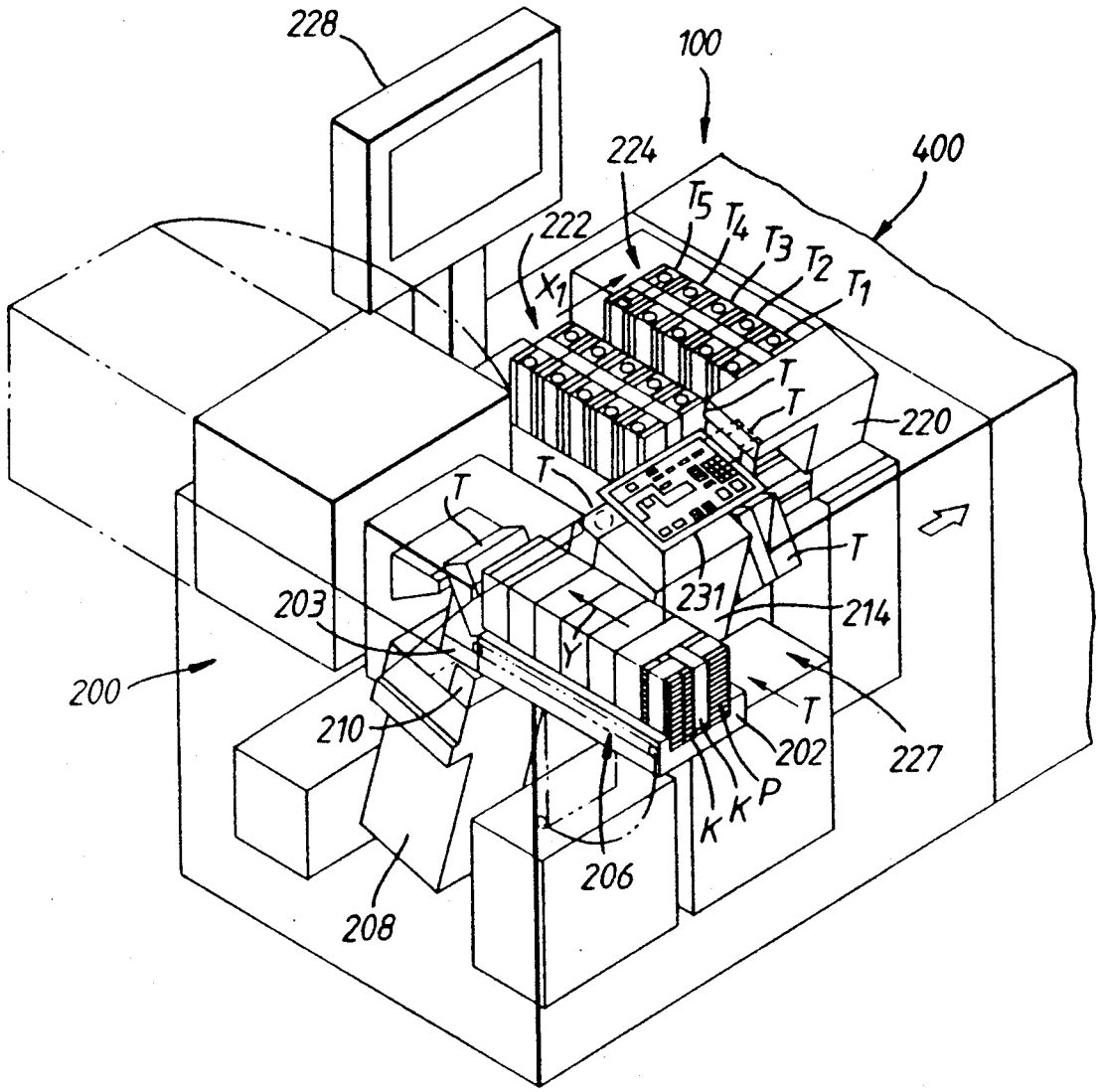
FIG. 1 is a perspective view showing the outer appearance and inner appearance of a bundle processing apparatus in accordance with the present invention.
Figure 2:
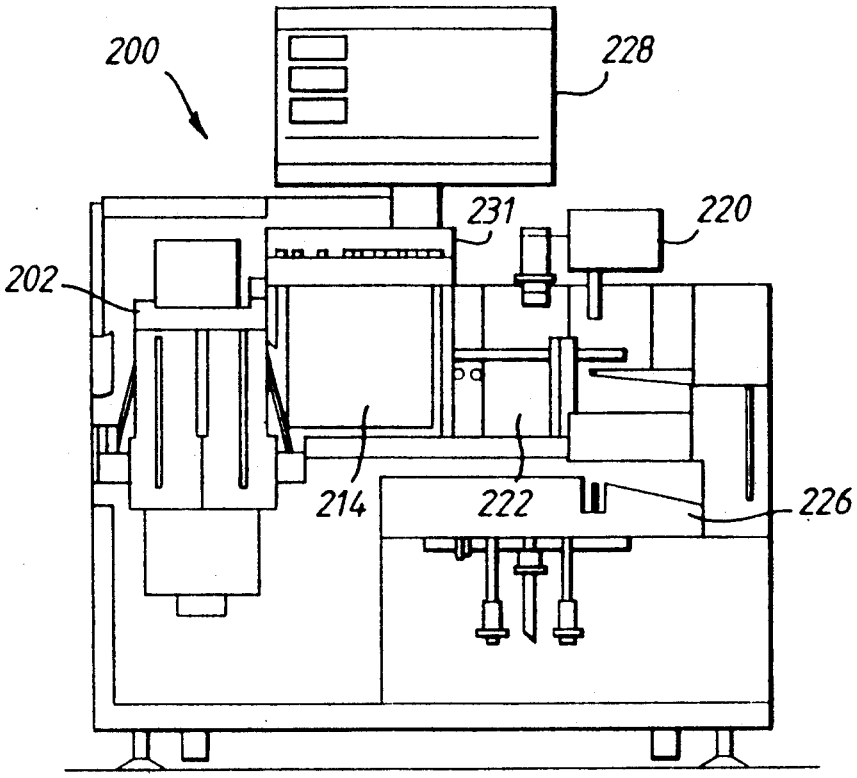
FIG. 2 is a front view of the bundle processing apparatus shown in FIG. 1.

With reference to FIG. 1, a bundle processing apparatus 100 is disclosed in accordance with the principles of the present invention.

The bundle processing apparatus 100 includes a bundle processing unit 200 for receiving and taking in a number of bundles T paper sheets of bank notes such as P, and a bundle storage unit 400 for storing the bundles T. The bank notes may be issued currency or other financial instruments. A normal bundle includes ten packs of bank notes, and each pack includes one hundred bank notes.

The bundle processing unit 200 is shown in FIGS. 1 through 4. A bundle receiver 202 is arranged atop of the bundle processing unit 200 to receive a number of bundles T. A conveyor 206 is part of the bundle receiver to convey each bundle T in the direction of the arrow Y shown in FIG. 1. A detecting device 201 detects the presence of the bundles on the conveyor 206 and outputs a detection signal. A drive means 203 drives the conveyor 206 in response to the detection signal. A denomination detecting section 208 is provided at the end of the conveyor 206, to detect the denomination of the bundled bank notes. A length detecting section 210 is arranged adjacent to the denomination detecting section 208 to detect the length L of the bundle T.

Figure 3:
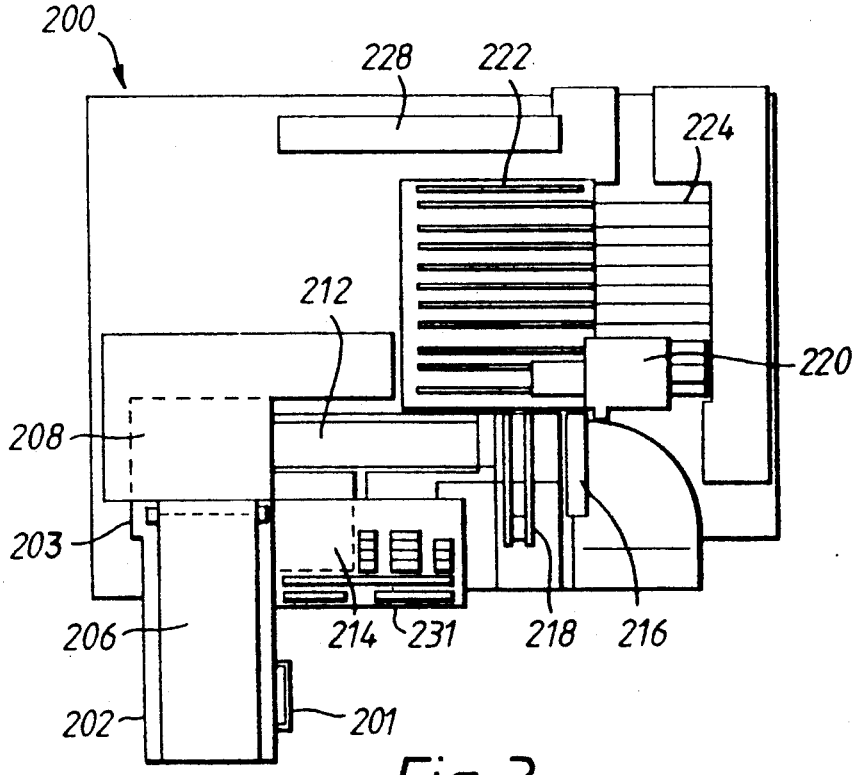
FIG. 3 is a plan view of the bundle processing apparatus shown in FIG. 1.
Figure 4:
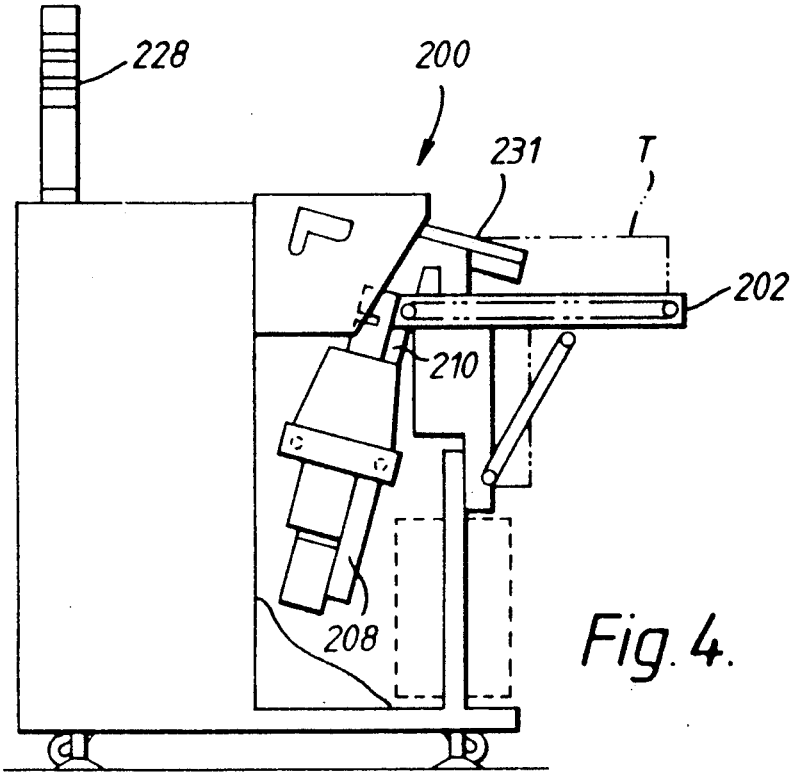
FIG. 4 is a left side view of the bundle processing apparatus shown in FIG. 1.

A ten-packs counting section 214 is arranged at the conveyance path of a bundle conveyor 212 to count the number of packs t, which are sealed by small bands, constituting the bundle T. The ten-packs counting section has a configuration similar to that of the length detecting section 210. The bundle conveyor 212, as shown in FIG. 3. is arranged between the denomination detecting section 208 and the ten-packs detecting section 214.

A stamping section 220 is arranged at the end of the bundle conveyor 212 to stamp the bundle T. A five bundle stacking section 222 to receive the bundles T from the bundle conveyor 212 is installed near the stamping section 220. A five bundle buffer 224 arranged at the side opposite to the five bundle stacking section 222 receives the bundles T fed from the five bundle stacking section 222 in the direction Xl as shown in FIG. 1. A five bundle storage section 226 is arranged under the five bundle buffer to receive five bundles and feed them to the bundle storage unit 400. A rejected bundle stacking section 227 is arranged at the end of the bundle conveyor 212 to stack any bundle T′ which is determined not to include a predetermined number of packs and is rejected.

An operation panel 231 is installed above the rejected bundle stacking section 227 to put in a denomination data of the bundle T, an amount data, and time data. A display means 228 including a liquid crystal display (LCD) is arranged at the rear side of the five bundle stacking section 222.

Figure 5:
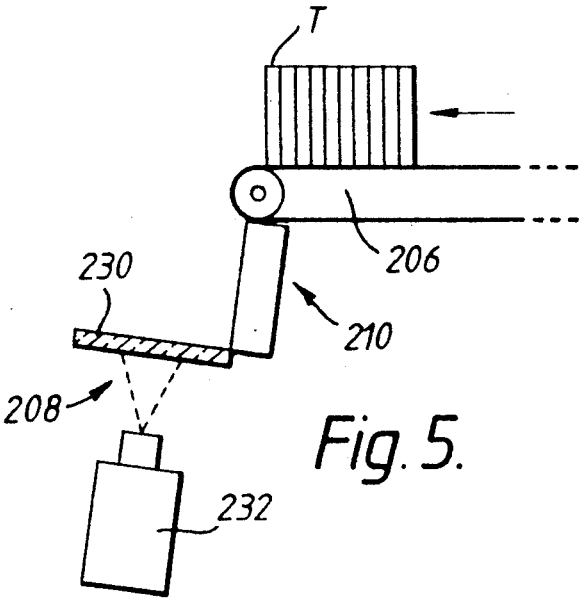
FIG. 5 is a side view of the denomination detecting unit of the bundle processing apparatus in accordance with the present invention.
Figure 6:
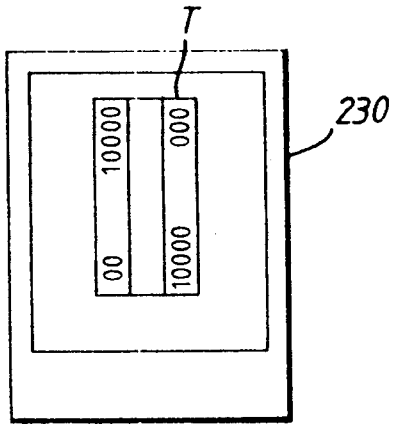
FIG. 6 indicates a typical pattern of a bank note detected by a denomination detecting unit.

The denomination detecting section 208 as shown in FIG. 5, includes a glass plate 230 arranged at the end of a conveyor 206 and a scanning camera 232 arranged under the scanning surface of the glass plate 230. An image of the bundle T is scanned by the scanning camera 232 as shown in FIG. 6. The scanned image information is supplied to the denomination checking unit 233. The denomination checking unit 233 discriminates the denomination of the bundle in accordance with the image information.

Figure 7:
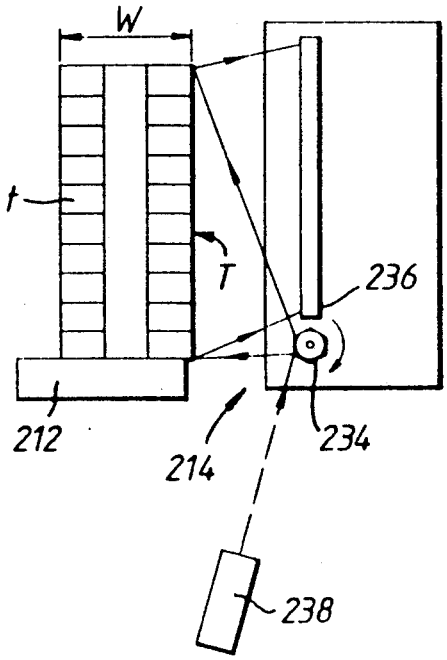
FIG. 7 is a schematic side view of a ten-packs detecting section in accordance with the present invention.

The length detecting section 210 is configured in a manner similar to the ten-packs counting unit 214 to be described below. The length detecting section 210 includes a rotary mirror, a light source for laser light and a light detecting element similar to rotary mirror 234, light source 238 and light detecting element 236 as shown in FIG. 7. The length detecting section 210 scans the small band section J shown in FIG. 8 and detects the bundle boundaries which have curvature and reflect the light poorly. A waveform of light detected by the light detecting element is obtained which is similar to that shown in FIG. 9 but has a low level only at the beginning and end of the length L. In accordance with the waveform detected, a detecting control section judges whether the length L is equal to a preset value for length.

The bundle conveyor 212 of FIG. 7 is arranged with its conveyance surface being substantially parallel to the glass plate 230 of FIG. 6. The ten-packs counting unit 214 is configured as shown in FIG. 7. A rotary mirror 234 is placed at a certain interval with respect to the bundle T to be conveyed and a light detecting element 236 is provided. A laser light source 238 is arranged below the rotary mirror 234 to irradiate laser light onto the rotary mirror 234.

Figure 8:
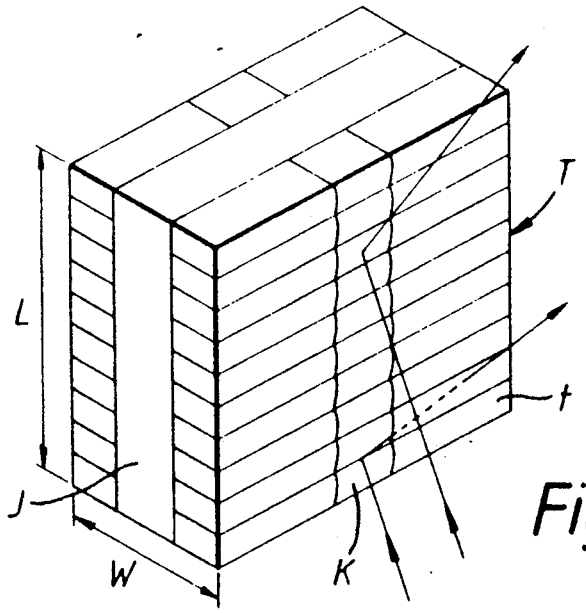
FIG. 8 is a perspective view showing the outer appearance of the bundle.
Figure 9:
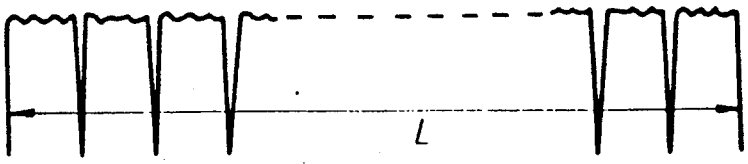
FIG. 9 illustrates signal waveforms sensed by a ten-packs detecting section.

As shown in FIGS. 8 and 9, laser light is irradiated from the laser light source 238 to the rotary mirror 234 being rotated and the small band section K sealing each pack t of the bundle T is scanned by light reflected by the rotary mirror 234. Since the corners (pack boundaries) of the small bands K sealing the packs t constituting the bundle T have curvature, strong reflective light from the small bands and weak reflective light from the boundary of the small bands are detected. Electrical signals having the waveform shown in FIG. 9 are obtained by the light receptor elements of element 236. In accordance with the electrical signals, a detecting control section judges whether the number of packs t is equal to a preset number or count, for example, ten.

If the number of packs detected equals the preset number of packs, for example, ten, and if the length L is equal to a preset value for length, the bundle T is determined by the detecting control section to be proper. If the number of packs detected is less than or more than the preset number of packs for a bundle or if the length of the bundle is significantly different from the preset value for length of a bundle, the bundle is determined to be improper and is rejected.

The temporary stacking unit for holding the bundles temporarily before feeding them to the bundle storage unit 400 via the five bundle storage section 226, will now be described with reference to FIGS. 10 to 12. A bundle direction conversion unit 240 shown in FIG. 10 includes five bundle buffer section 224 and is placed facing the rear stage of the five bundle stacking section to receive the five bundles T1 to $T_5$. A drive means 244 drives the buffer section 224 for turning in the directions $P_1$ and $P_2$ shown in FIG. 12. An auxiliary turning plate 246 is placed coaxially to the buffer section 224 and is turned together with the latter. Turning restriction means 293 restrict the position of the auxiliary turning plate 246 turning in and $P_2$ directions. A vertical movement feature 302 moves the bundle direction conversion unit 240 in the Z1 and Z2 directions shown in FIG. 11.

The five bundle buffer section 224 includes five mounted plates 250 with the same shape and one end of each of plates 250 is installed in parallel to a drive shaft 252 constituting the drive means 254. The other end of each of the mounting plates 250 is provided with a square element passing section (hole) 256.

The drive means 254 comprises a drive motor 258 fixed on the side of the mounting plate 250 and a turning feature turned by the drive motor 258.

Figure 12:
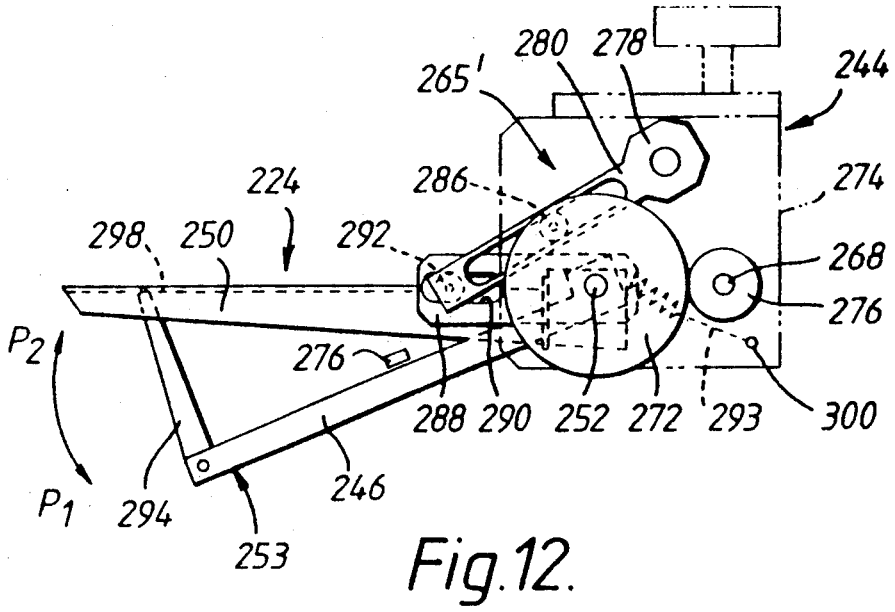
FIG. 12 is a right side view of the temporary stacking unit.

The turning feature comprises a turning force transmission mechanism 264 that transmits the turning force of the drive motor 258 and a turning drive section 265 that converts the turning force into a force in the directions $P_1$ and $P_2$ for turning the mounting plate 250 as shown in FIG. 12.

The turning force transmission mechanism 264 includes a prime gear 266 installed on the prime shaft of the drive motor 258; a transmission shaft 268 arranged in parallel to the drive shaft 252 at the rear of the mounting plates 250; a first transmission gear 270 that is secured on one side to the end of the transmission shaft 268 and engaged with the prime gear 266; and a second transmission gear 270' that is secured to the other end of the transmission shaft 268.

Figure 10:
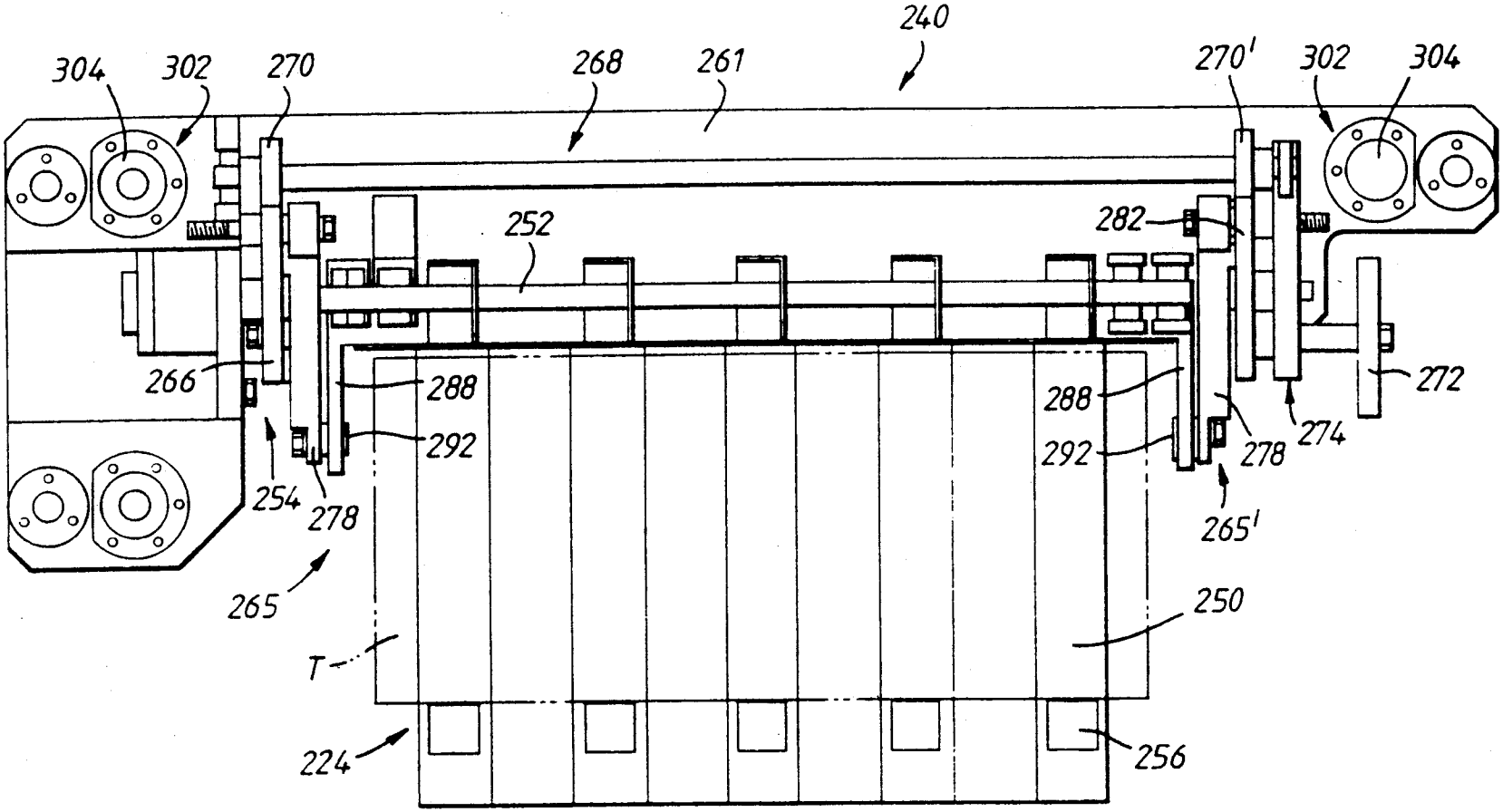
FIG. 10 is a plan view of a temporary stacking unit in accordance with the present invention.
Figure 11:
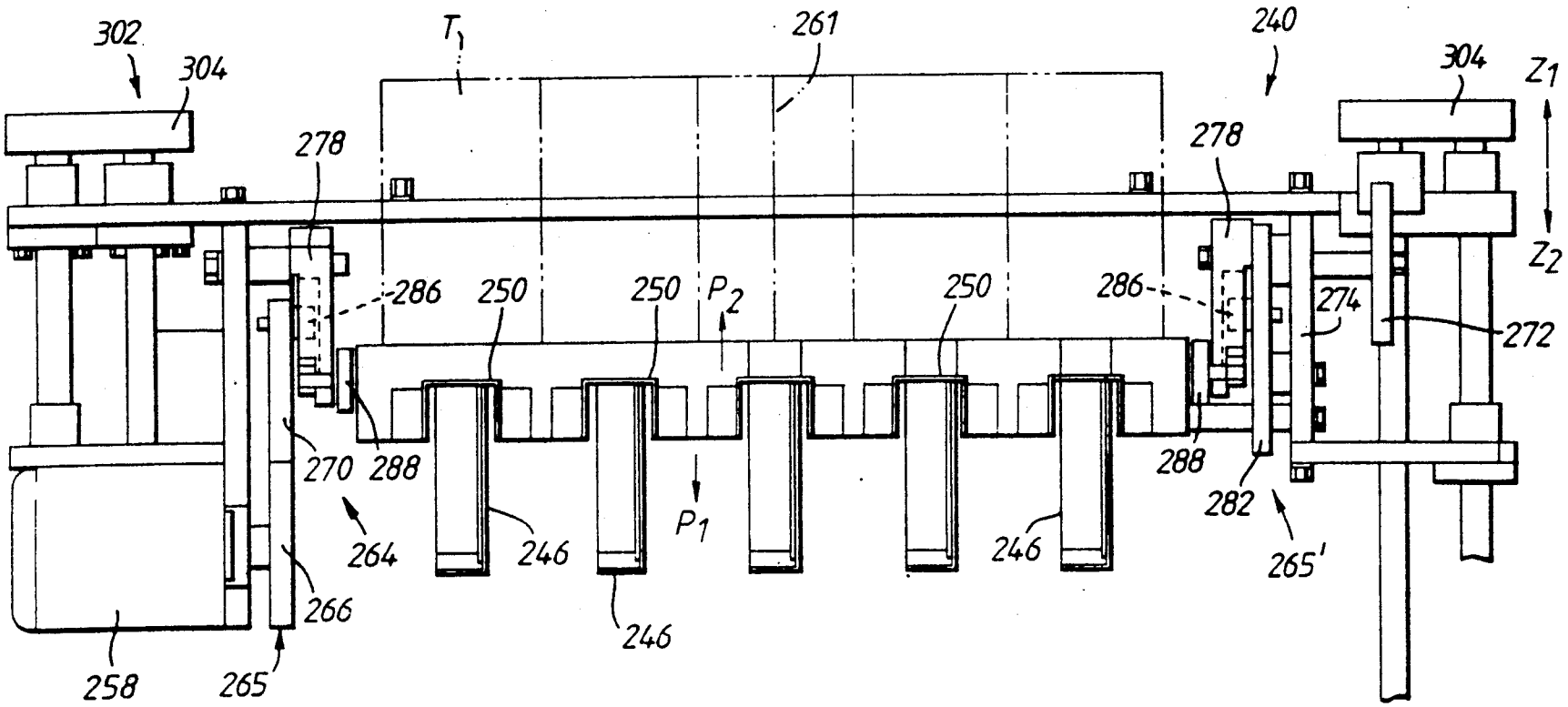
FIG. 11 is a front view of the temporary stacking unit.

The turning drive sections 265 and 265' are arranged symmetrically with respect to the central vertical line 261 in FIGS. 10 and 11.

The right turning drive section 265' comprises a turning gear 272 that is pivotably supported by a vertical plate 274 placed near the mounting plate 250 and is engaged with the second transmission gear 270'. An arm 278 with a long hole 280 is placed along the turning gear 282 which has one side supported by the vertical plate 274 and the other side facing the side of the mounting plate 250. A first cam follower 286 is installed on the side wall of the turning gear 282 and engages the long hole 280 of the arm 278. A holder 288 with a slide hole 290, a first end installed on the turning shaft 252 and a second end facing the projected end side of the arm 278 receives a second cam follower 292. The cam follower 292 is installed on the projected end side of the arm 278 and engages the slide hole 290 of the holder 288.

The auxiliary turning section 253, as shown in FIG. 12, comprises five auxiliary turning plates 246 each with one end which is mated rotatably into the turning drive shaft 252 and a second end which is projected below the mounting plate 250 at the positions corresponding to the mounting plate 250. The auxiliary turning section also includes five item support elements 294 which are projected from the second end of the auxiliary turning plates 246 at an angle of 90 degrees.

As shown in FIG. 12, a fixed stopper 296 comes in contact with the top of each auxiliary turning plate 246 and adjusts a position of each auxiliary turning plate 246 so that the end of the item support element 294 projects from the second end of the auxiliary turning plate 246. A turning restriction spring 293 is arranged between a fixing pin 300 disposed on the vertical plate 274 and an end of the auxiliary turning plate 246 opposite item support element 294 to force the auxiliary turning plate 246 in the $P_2$ direction, thereby restricting its position in the $P_1$ direction and turning the auxiliary turning plate 246.

The vertical movement mechanism 302 includes a ball screw 304. Turning the ball screw 304 causes the bundle direction conversion unit 240 to be moved vertically in the Z1 and Z2 directions.

The bundle stack storage unit 400 will be described below with reference to FIG. 13.

The bundle storage unit 400 includes a belt conveyor 402 that is installed on the upper surface of the bundle storage unit 400. A case lowering section 404 is arranged at the end of the belt conveyor 402 to receive a case C from the belt conveyor. The case travels in the X2 direction indicated by the arrow in FIG. 13 with its opening facing the bundle processing unit 100. The case lowering section lowers the case C vertically in the Z3 direction until the case C for receiving the five bundles is disposed to face the five bundle storage section 226. After the case C, lowered by the case lowering section, has been filled with five bundles by the five bundle storage section 226, a belt conveyor 406 feeds the case C to the belt conveyor 409 in the X1 direction as shown in FIG. 13. A case turning section 408 is arranged at the end of the belt conveyor 406 to turn the case C containing the stack of bundles T so that its opening faces upward. A belt conveyor 409 conveys the turned case C further in the X1 direction. A filled case discharge section 410 is located at the side of the bundle storage unit 400 opposite the bundle processing unit and receives the case C fed by the belt conveyor 410. The case C can be manually taken out of the bundle storage unit 400 from the filled case discharge section 410 covered by a cover C1.

Figure 16:
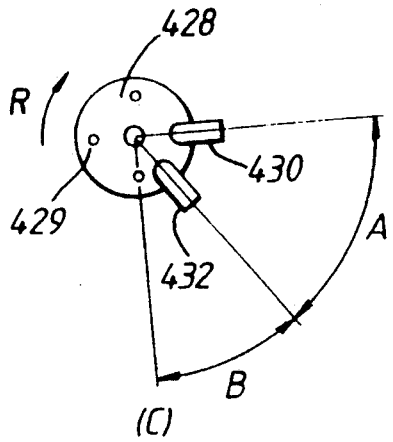

The case turning section 408 will now be described with reference to FIGS. 14, 15, 16, 17(A) and 17(B). FIGS. 15, 16, 17(A) and 17(B) illustrate side views of components shown in FIG. 14 as viewed from the Q direction. The case turning section 408 comprises a central shaft 411 shown in FIG. 14 that is placed between the roller conveyor 406 and the belt conveyor 410 and is rotatably supported by bearings 412 and 414. Cross turning arms 416 and 418 are each arranged at a predetermined interval along the central shaft 411. A worm gear 420 is located by the portion of the central shaft 411 projecting outwardly from the bearing 416. A motor 422 drives the worm gear 420 which engages gear 424 to drive the central shaft. A sensor plate 428 is secured at the end of the central shaft 411 and is provided with four holes 429 arranged at intervals of 90 degrees as shown in FIG. 16. Angle detectors 430 and 432 are arranged at an interval of an angle A on the circumference of the sensor plate 428. A receiver side sensor 440 consisting of a light emission element 438 and a light reception element 436 establishes a light path crossing the roller conveyor 406 and a delivery side sensor 442 consisting of a light emission element 444 and a light reception element 446 establishes a light path crossing the belt conveyor 410.

Figure 17A:
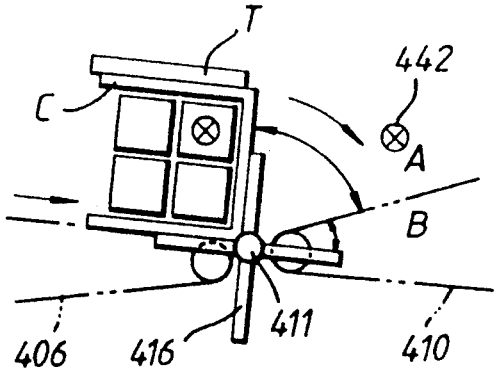
FIGS. 17(A) and (B) are front side views illustrating the operation of the case turning mechanism from direction Q shown in FIG. 14.
Figure 17B:
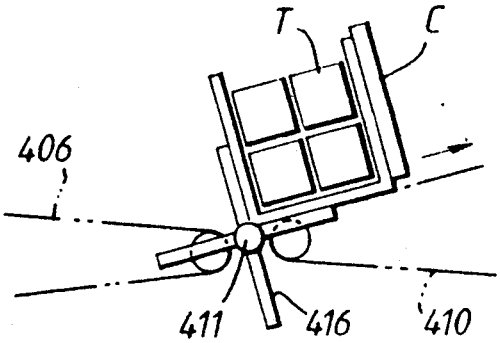

Once the angle detector 430 has detected the hole 429 of the sensor plate 428, the following operations are performed. When the case C is sent to the case turning section 408 in the X1 direction by the roller conveyor 406 and the receiver side sensor 440 detects the case C, the delivery side sensor 442 does not generate a signal indicating the presence of the case, and the motor 422 is started after a certain period of time. With the rotation of the motor 422, the sensor plate 428 is also rotated in the R direction shown in FIG. 16. A detection signal indicating the detection of the hole 429 on the sensor plate 428 by the sensor 430 is fed to the motor 422, whereby the motor 422 is stopped. Thus, the case C is turned by the angle A and, as shown in FIG. 17(B), the case C is mounted on the belt conveyor 410.

Next, when the receiver side sensor 440 does not detect the presence of a case, the motor 422 is started again. The turning arms 416 and 418 are turned by the angle B as shown in FIG. 17(A). When the sensor 430 detects the next hole 429, the motor 422 is stopped. As shown in FIG. 17(A), the next case C is mounted and one step of operation is terminated. In the above manner, the case C can be turned by the angle A without breaking the bundle T in the case C.

Figure 13:
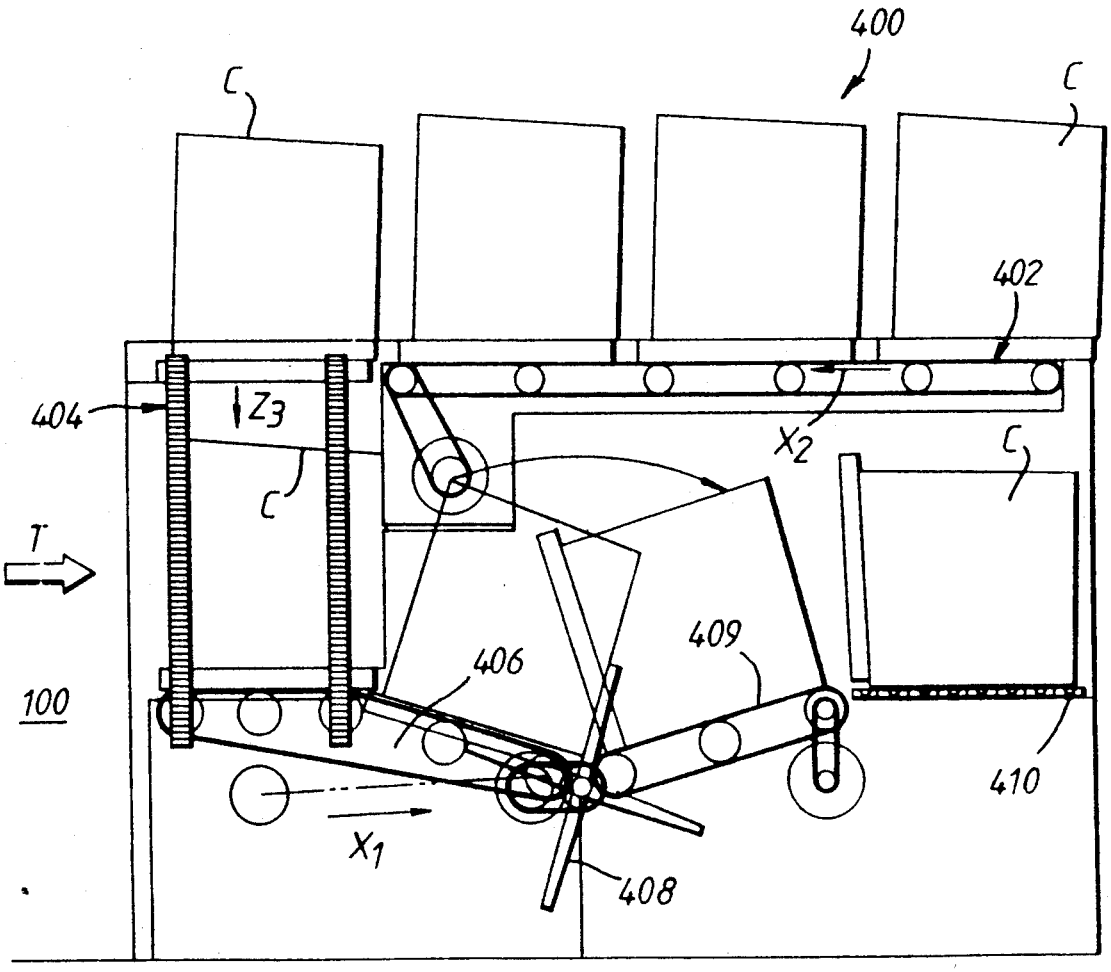
FIG. 13 is a schematic side view of a bundle storage unit in accordance with the present invention.
Figure 14:
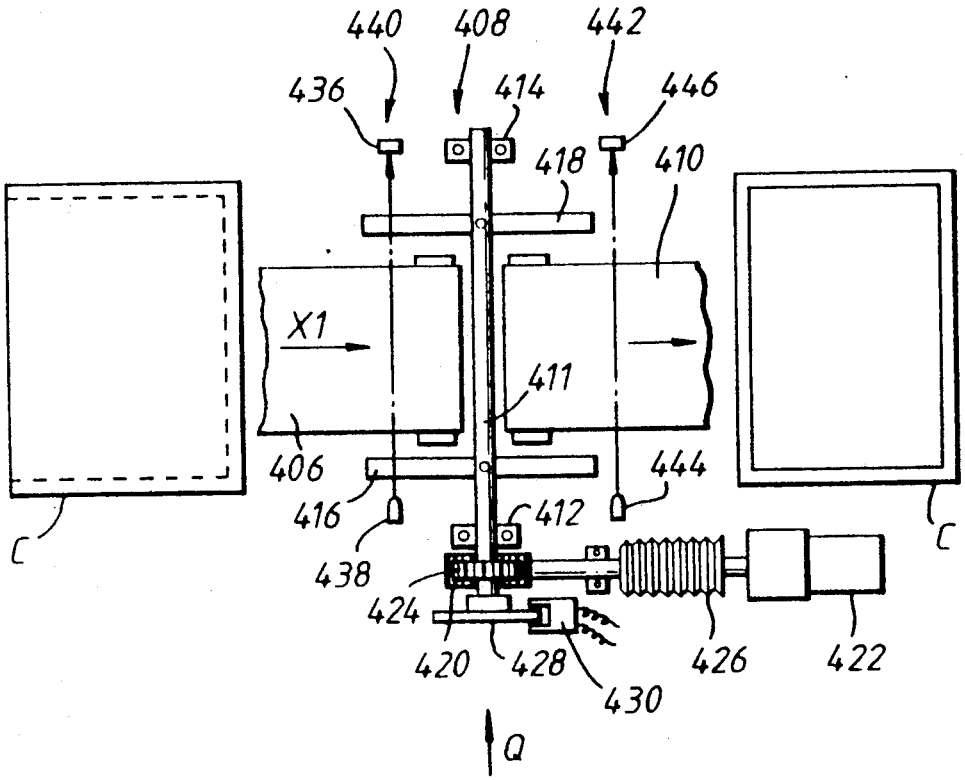
FIG. 14 illustrates a case turning mechanism in accordance with the present invention.
Figure 15:
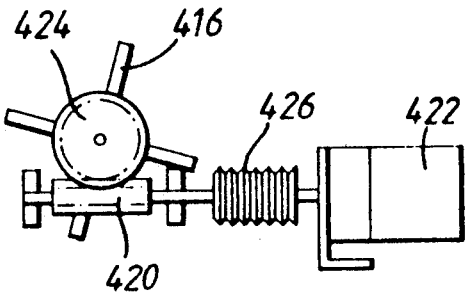
FIGS. 15 and 16 are first side views showing the details of the essential part of the case turning mechanism from direction Q shown in FIG. 14.

The case C is carried on the belt conveyor 402 shown in FIG. 13 and receives five bundles T from the five bundle storage section 226. It is assumed for the convenience of description that the bundles T consist of bundles $T_1$ through $T_5$ as shown in FIG. 1.

Figures 19, 20:
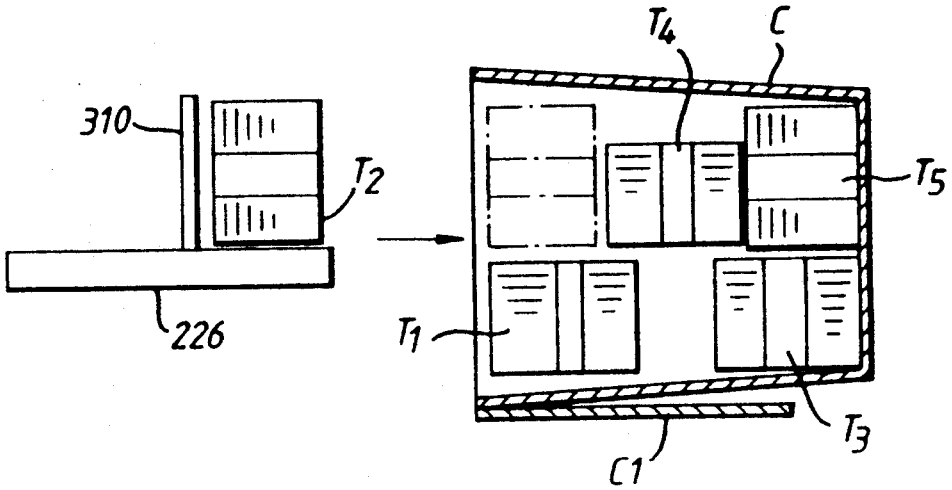
FIG. 19 illustrates the operation of the bundle storage unit.
FIG. 20 shows a printed journal.
Figure 21A:
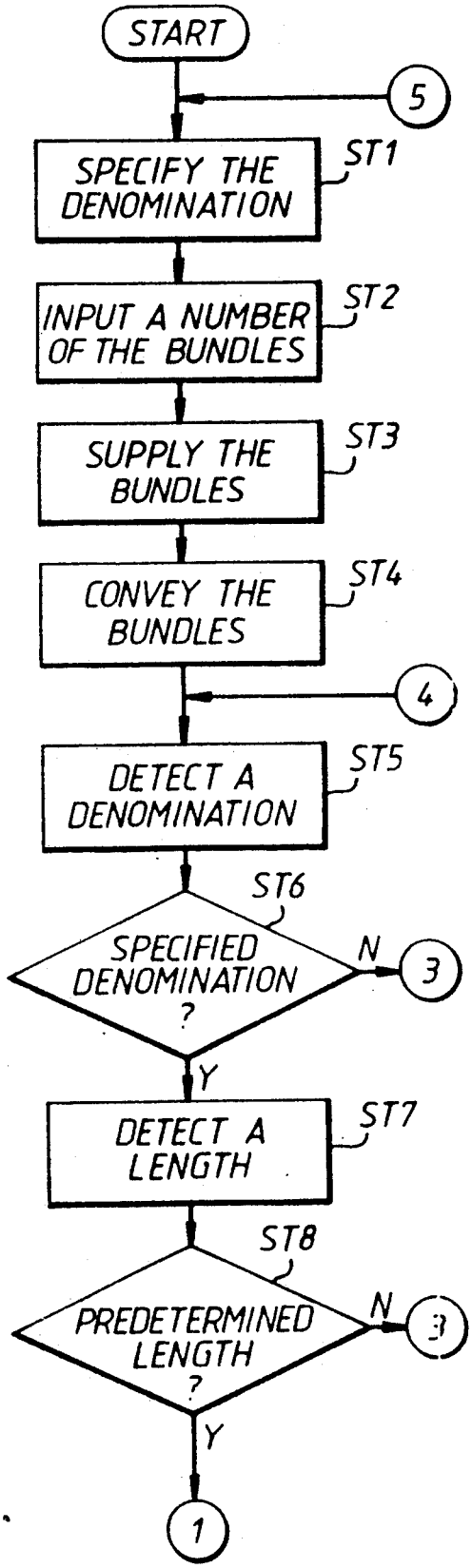
FIGS. 21 (A)-(D) are flow charts for explaining the operation of the apparatus according to the present invention.
Figure 21B:
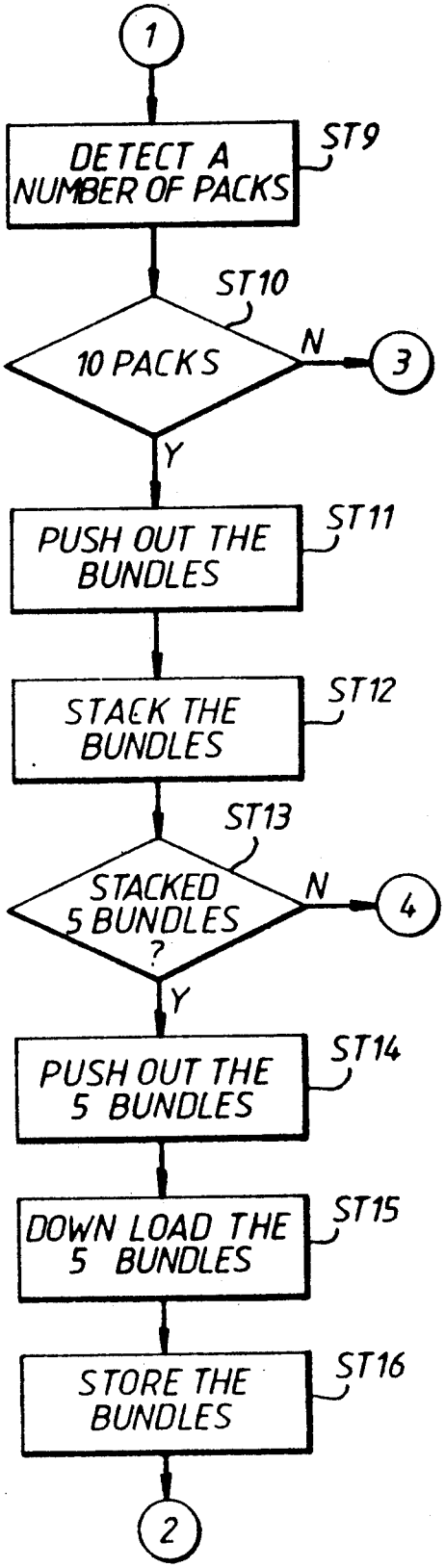
Figure 21C:
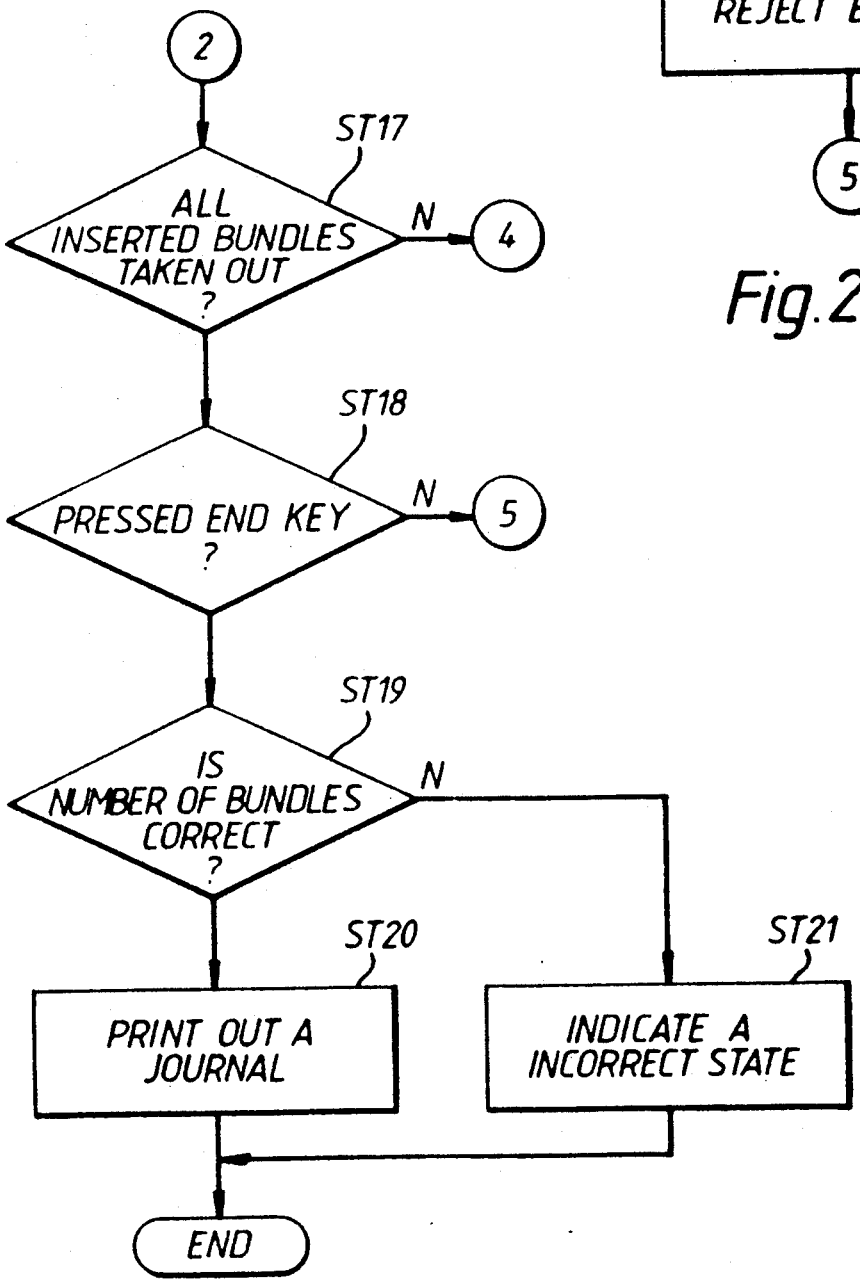
Figure 21D:
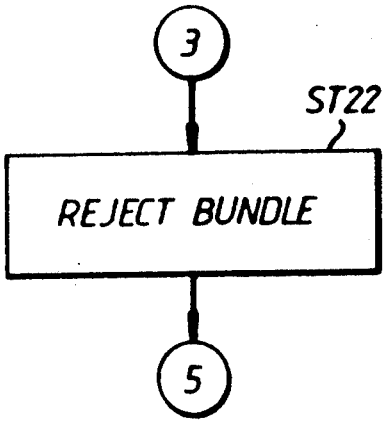

The bundle storage section 226 receives the group of five bundles ($T_1$ through $T_5$) from the five bundle buffer 224 in order to supply them to the bundle storage unit 400. The bundle storage unit 400 includes a push out mechanism 310 shown in FIG. 19 for pushing out the five bundles into the case C. The five bundle storage unit accumulates the bundles $T_1$ through $T_4$ so that $T_1$ and T3 are placed below bundles $T_2$, $T_4$ and $T_5$ and the direction of bundles $T_2$ and $T_5$ is different from that of bundles $T_1$, $T_3$ and $T_4$ by 90 degrees. Then the push out mechanism pushes the bundles $T_1$ through $T_5$ into the case C in the direction of the arrow as shown in FIG. 19.

The direction of bundles $T_2$ and $T_5$ is different from that of bundles $T_1$, $T_3$ and $T_4$, so that after the case C storing the bundles $T_1$ through $T_5$ is turned by the case turning section 408 in the bundle storage unit 400 in order to orient the opening face upward, marks on the bundles $T_1$ through $T_5$ can be checked easily by visual inspection.

Figure 18:
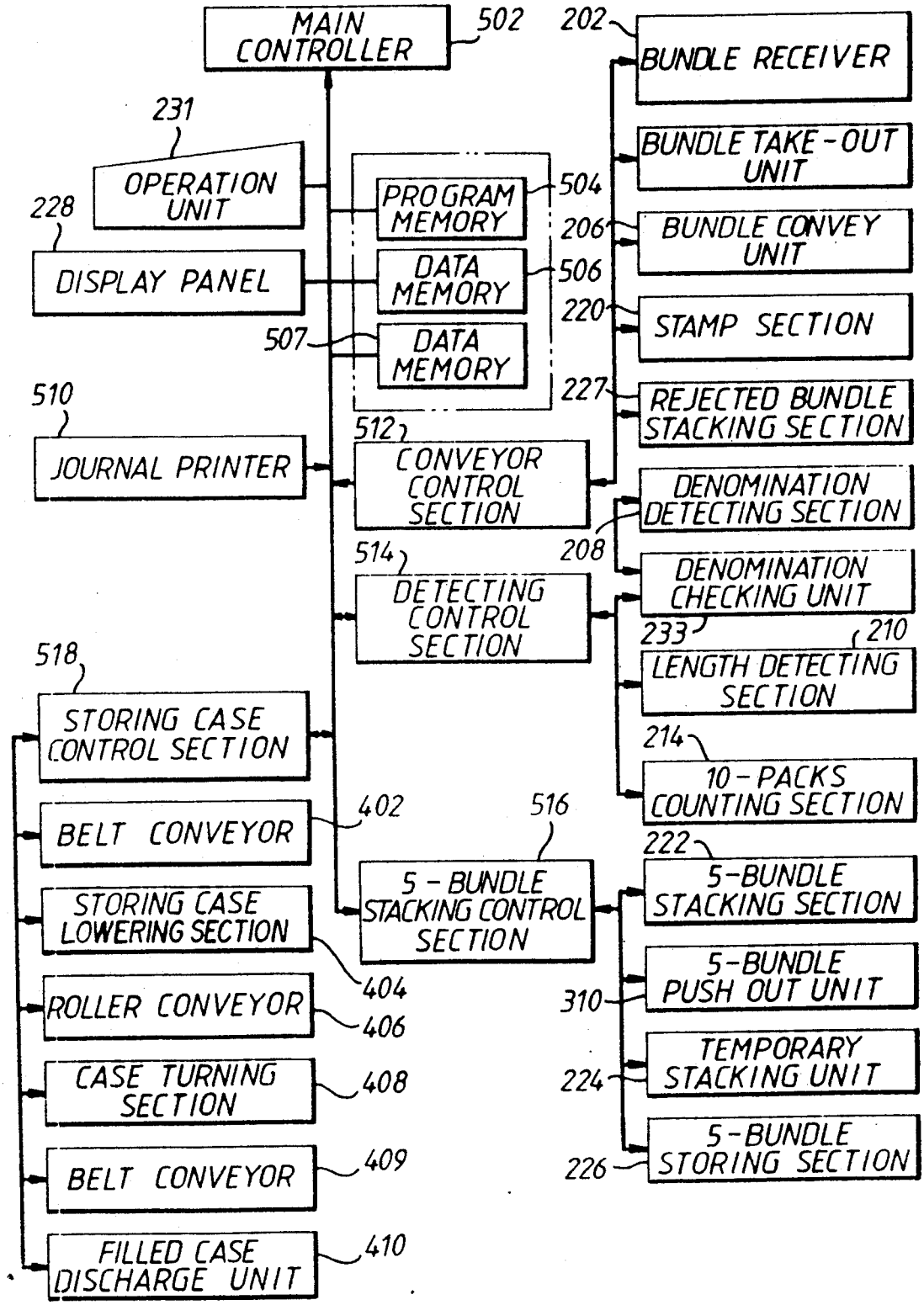
FIG. 18 is a block diagram of the bundle processing apparatus.

FIG. 18 is a block diagram explaining the operation of the bundle processing apparatus 100.

The control system includes a main control section 502, a program memory 504 storing operation programs, and a data memory 506 storing the control data. The main control section 502 is connected to the operation unit 231, the display means 228, and the journal printer 510.

The data memory 506 stores detected denomination data, data on the lengths of the bank note kinds, and the preset number of packs, for example ten, constituting the bundle.

A bundle conveyor control section 512, a detecting control section 514, a five bundle stacking control section 516, and a storing case control section 518 are connected to the main control section 502. The bundle conveyor control section 512 controls the bundle receiver 202, the bundle conveyor 206, the stamping section 220, and the rejected bundle stacking section 227. The detecting control unit 514 controls the denomination detecting section 208, the length detecting section 210, and the ten-packs counting section 214. The five bundle stacking control section 516 controls the five bundle stacking section 222, the five bundle buffer 224, and the five bundle storing section 226, and the five bundle push out mechanism 310.

The storing case control unit 518 controls the belt conveyor 402, the storing case lowering section 404, roller conveyor 406, case turning section 408, belt conveyor 409 and filled case discharge unit.

The operation of the bundle processing apparatus having the construction described above will be described with reference to the flow chart shown in FIGS. 21 (A)-(D).

First, the equipment operator inputs data representing the number of bundles T and the denomination of the bundles to be processed into the bundle processing apparatus by the operation panel 231 (ST1, ST2). The denomination data and data representing the number of bundles T entered from the operation panel 231 is sent to the display means under control of the main control section 502. Thus, the data can be visually checked before and after inputting it. Next, the operator supplies the bundles T to the bundle receiver 202 (ST3). At this step, the information displayed on the display means 228 is erased under the control of the main control section 502.

When the equipment is started, the bundles T are transported intermittently in the Y direction by the bundle conveyor 206 as shown in FIG. 1 (ST4). When the bundles T reach the denomination detecting section 206, the denomination of the bank notes are discriminated (ST5). At that time, the main control section 502 judges whether the denomination detected by the denomination detecting section 206 is equal to the entered denomination by the operation unit 231 (ST6). When the bundles T reach the length detecting section 210, the length of the bank notes is measured in a manner similar to that shown in FIGS. 7 to 9 (ST7). At that time, the main control section 502 judges whether the length detected by the length detecting section 210 is equal to the predetermined length (ST8).

Data regarding the length and denomination discriminated are sent to the main control section 502. Then, the bundle T is removed from bundle receiver 202 via conveyor 206, conveyed in the X1 direction by the conveyor 212 and passes the position (1) shown in FIG. 1. At that time, the ten-packs counting section 214 counts the number of packs t constituting the bundle T (ST9)and judges whether or not the bundle T can be stored in the case C (ST10). The results counted by the ten-packs counting section 214 are also sent to the main control section 502.

The main control section 502 judges whether the length L, the denomination, and the number of packs discriminated are the same as the information entered from the operation panel 231. The bundles T having the specified denomination, length and number of packs, for example, ten, are judged to be proper. Using these judgment results, the stamping section stamps the bundles T judged proper. The bundles T are pushed out by a push out member 218 (ST11) and are stacked into the five bundle stacking section 222 (ST12). The number of bundles T, and their amount and total amount are displayed by the display means 228.

If the collation of information regarding a bundle about the length L, denomination, and the number of packs by the main control section 502 has indicated greater or smaller length L, different bank note kind, or the number of packs less than or more than the specified number such as ten, the bundle T is judged to be improper and is rejected to the rejected bundle stacking section 227 (ST22). In that case, the number of rejected bundles can be displayed by the display means 228.

After five bundles judged proper are stacked in the five bundle stacking section 222 (ST13), the bundles $T_1$ to $T_5$ are pushed in the X1 direction indicated by an arrow in FIG. 1, (ST14), reach the five bundle buffer 224, and are turned in the directions as shown in FIG. 12, by the bundle direction conversion unit 240. The bundles are fed into the bundle storage unit 400 via the five bundle storage section 226. The stacks are stored into a case C by the five bundle storage section 226 employing push out mechanism 310 (ST16), as shown in FIG. 19. After five of the bundles T have been stored into one case C, the case C is moved in the bundle storage unit 400 in the X1 direction by the roller conveyor 406, turned by the case turning section, and conveyed in the X1 direction by the belt conveyor 402. Thus, the case C is fed to the filled case discharge section 410 and awaits manual handling.

After the filled case C has been sent out from the case lowering section by the roller conveyor, the case lowering section 404, supporting the next empty case C, faces the empty case towards the five bundle storage section 226 to store the subsequent five bundles. An operator mounts empty cases on the bundle storage unit 400 and takes the case C containing the bundles T out of the right side of the bundle storage unit 400 shown in FIG. 13, which facilitates case processing and arrangement and thus, enhances the working efficiency of the apparatus. The case C containing the bundles T taken out from the storage unit 400 is attached manually with a slip describing its contents, covered by the cover C1, and stored in the safe. Thus, a series of operations for handling the bank note bundles T by the apparatus described as a preferred embodiment is complete. The operator specifics a next denomination by inputting data into the operation panel 231 to repeat the processing for the next bundles. At this step, less than five bundles may be left in the five bundle stacking section 222 or the case C, which wait for five bundles to accumulate, or to be pushed into the case, respectively. In such a case, the bundles are removed manually and the case C is discharged automatically by the bundle storage unit 400.

After the end of a processing cycle of the apparatus (ST17), the operator directs processing to stop by the operation panel 231. (ST18). Thus, the operation is stopped, with data on all processing stored in the data memory 506. The equipment collates information set from the operation panel 231 with the data actually processed by the apparatus.

If the results of this collation are proper (ST19), the journal printer prints out a journal having the contents shownin FIG. 20 (ST20) to complete the preparations for the next handling. FIG. 20 shows the form of the slip printed by the journal printer 510. The journal printer 510 prints out to journal the data, the denomination, the number of bundles, the time, the machine number, the journal number, the amount, the keyed in amount, and the total amount.

If the results of the collation do not correspond to the specified data, the display means 228 flashes an indication of that effect and, at this step, the equipment is electrically locked by an operation program (ST21). To free this lock, a checking key (not shown) on the operation panel 231 is depressed. Correction processing, e.g., the correction of initially entered data, is carried out and a reset switch (not shown) on the operation panel 231 is depressed, making the apparatus ready for further operation.

Although, in accordance with the foregoing embodiment of the present invention, ten packs constitute a bundle and five bundles are stacked and then stored in a single case, the embodiment may be modified for any number of packs in a bundle or bundles to be stored together.

What is claimed is:

1. A bundle processing apparatus comprising:

means for receiving a plurality of bundles, wherein each bundle includes a number of packs and each pack includes a plurality of paper sheets;

intermediate means for conveying the bundles away from said means for receiving;

means for counting the number of packs included in each bundle conveyed by said intermediate means for conveying;

means for detecting a length of each bundle;

means for stacking a bundle when the number of packs counted by said means for counting is equal to a predetermined number and the length detected by said detecting means is equal to a predetermined length;

means for rejecting a bundle when the number of packs counted by said means for counting is not equal to said predetermined number or the length detected by said detecting means is not equal to the predetermined length; and means for storing stacked bundles in a storage box.

2. A bundle processing apparatus according to claim 1, wherein said means for receiving comprises:

conveying means, on which said bundles are placed, for conveying said bundles to said intermediate means for conveying;

detecting means for detecting a presence of said bundles on said conveying means of said receiving means and outputting a detection signal; and drive means for causing the conveying means of said receiving means to convey said bundles in response to said detection signal.

3. A bundle processing apparatus according to claim 1, further comprising:

means for entering bundle denomination data into the bundle processing apparatus;

means for detecting a bundle denomination of a bundle being processed; and means for comparing the denomination detected by said denomination detecting means with the entered denomination data, and wherein said means for rejecting rejects a bundle when the denomination detected by said denomination detecting means is not equal to the entered denomination data.

4. A bundle processing apparatus according to claim 1, wherein said means for storing comprises:

means for conveying an empty storage box to a predetermined location for receiving stacked bundles;

means for filling said storage box with bundles that are not rejected by said rejecting means; and means for conveying filled boxes from said predetermined location to a discharge section.

5. A bundle processing apparatus comprising:

means for entering bundle denomination data;

means for receiving a plurality of bundles, wherein each bundle includes a number of packs and each pack includes a plurality of paper sheets;

intermediate means for conveying the bundles away from said means for receiving;

means for counting the number of packs included in each bundle conveyed by said intermediate means for conveying means for detecting a denomination of each bundle;

means for stacking a bundle when the number of packs counted by said means for counting is equal to a predetermined number and the denomination detected by said detecting means is equal to the entered denomination data;

means for rejecting a bundle when the number of packs counted by said means for counting is not equal to the predetermined number of the denomination detected by said detecting means is not equal to the entered denomination data;

means for conveying an empty storage box to a predetermined location for receiving stacked bundles;

means for filling said storage box with stacked bundles; and means for conveying filled boxes from said predetermined location to a discharge section.

6. A bundle processing apparatus according to claim 5, wherein said means for receiving comprises:

conveying means, on which said bundles are placed, for conveying said bundles to said intermediate means for conveying;

detecting means for detecting a presence of said bundles on said conveying means of said means for receiving and outputting a detection signal; and drive means for causing the conveying means of said means for receiving to convey said bundles in response to said detection signal.

7. A bundle processing apparatus according to claim 5, further comprising means for detecting a bundle length, and wherein said means for rejecting rejects a bundle when the detected length of a bundle is not equal to a predetermined length.

* * * * *